US011394140B2

(12) United States Patent
Yu

(10) Patent No.: US 11,394,140 B2
(45) Date of Patent: Jul. 19, 2022

(54) EMBEDDED TERMINAL MODULE AND CONNECTOR AND ASSEMBLING AND CORRECTING METHOD THEREOF

(71) Applicant: Kuo-Chi Yu, Taipei (TW)

(72) Inventor: Kuo-Chi Yu, Taipei (TW)

( * ) Notice: Subject to any disclaimer, the term of this patent is extended or adjusted under 35 U.S.C. 154(b) by 10 days.

(21) Appl. No.: 17/087,641

(22) Filed: Nov. 3, 2020

(65) Prior Publication Data

US 2022/0140506 A1 May 5, 2022

(51) Int. Cl.

| | |
|---|---|
| ***H01R 12/58*** | (2011.01) |
| ***H01R 12/72*** | (2011.01) |
| ***H01R 13/11*** | (2006.01) |
| ***H01R 43/24*** | (2006.01) |
| ***H01R 12/73*** | (2011.01) |
| ***H01R 12/70*** | (2011.01) |
| ***H01R 43/20*** | (2006.01) |
| ***H01R 13/405*** | (2006.01) |

(52) U.S. Cl.

CPC ..... *H01R 12/58* (2013.01); *H01R 12/707* (2013.01); *H01R 12/727* (2013.01); *H01R 12/73* (2013.01); *H01R 13/11* (2013.01); *H01R 13/405* (2013.01); *H01R 43/205* (2013.01); *H01R 43/24* (2013.01)

(58) Field of Classification Search

CPC .... H01R 12/58; H01R 12/707; H01R 12/727; H01R 12/73; H01R 13/11; H01R 13/405; H01R 43/205; H01R 43/24

See application file for complete search history.

(56) References Cited

U.S. PATENT DOCUMENTS

| | | | | |
|---|---|---|---|---|
| 11,179,063 | B1 * | 11/2021 | Filipovic | H04B 1/3822 |
| 2011/0104952 | A1 * | 5/2011 | Teh | H01R 12/737 439/633 |
| 2018/0191093 | A1 * | 7/2018 | Phillips | H01R 13/516 |
| 2021/0288423 | A1 * | 9/2021 | Guo | H01R 12/721 |
| 2021/0376508 | A1 * | 12/2021 | Hu | H01R 13/2457 |
| 2021/0408724 | A1 * | 12/2021 | Li | H05K 7/12 |

* cited by examiner

*Primary Examiner* — Truc T Nguyen

(74) *Attorney, Agent, or Firm* — Raymond Chan

(57) ABSTRACT

An embedded terminal module includes an embedded terminal component, a matching socket and a correction device. The correction device is located between the embedded terminal component and the matching socket to provide a coordinated correction of the embedded terminal component and a printed circuit board.

14 Claims, 9 Drawing Sheets

EMBEDDED TERMINAL MODULE AND CONNECTOR AND ASSEMBLING AND CORRECTING METHOD THEREOF

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The Present Invention Relates to a Connector, and More Particularly to an embedded terminal module, a connector and an assembling and correcting method thereof, so as to provide a correction effect during assembly, so that the embedded terminal module is smoothly joined with a printed circuit board.

DESCRIPTION OF RELATED ARTS

Nowadays rapid industrial development, which is an important component of the electronic connector is also in a state of rapid development. In order to allow products to perform better, various connector manufacturers are committed to developing new connector technologies.

That is to say, the connector is a common electronic component, which is often used between the printed circuit board and the printed circuit board for signal transmission. To put it another way, the connector is the core center of the electronic transmission interface, and the quality of the connector will affect the service life of the product. However, as shown in FIG. 1, the conventional connector 100P usually inserts a plurality of terminals 10P directly into the plastic component 20P. In this way, when a plurality of the terminals 10 are combined with a printed circuit board, the unevenness of the terminals 10P will cause assembly failure. In other words, it is difficult for the terminals 10P of the conventional connector 100P to be highly uniform arranged on the plastic component 20P. Moreover, the terminals 10P are directly inserted into the plastic component 20P of the connector 100P, so when the terminals 10P are combined with the printed circuit board, it is easy to cause the phenomenon that the terminals 10P cannot be connected to the printed circuit board. In other words, since the terminal 10P cannot be adjusted during assembly, the connector 100P is poorly assembled.

SUMMARY OF THE PRESENT INVENTION

An object of the present invention is to provide an embedded terminal module and a connector, and an assembling and correcting method thereof, in which a correction device is provided, so that an embedded terminal module can be smoothly assembled with a printed circuit board. In other words, when there is unevenness between the embedded terminal module and the printed circuit board, the relative position of the terminal and the printed circuit board is fine-tuned by means of correction, so that the terminal and the printed circuit board are connected smoothly.

An object of the present invention is to provide an embedded terminal module and a connector, and an assembling and correcting method thereof, in which the problem of unevenness between the terminals can be improved. At the same time, the terminals and the printed circuit board can be smoothly joined by the correction device.

An object of the present invention is to provide an embedded terminal module and a connector, and an assembling and correcting method thereof, wherein at least one embedded terminal element is adjusted in at least any one of the six axes of X, Y, Z, U, V and W.

An object of the present invention is to provide an embedded terminal module and a connector, and an assembling and correcting method thereof to reduce assembly tolerances and strengthen structural strength.

An object of the present invention is to provide an embedded terminal module and a connector, and an assembling and correcting method thereof, wherein an embedded element is used to cover a terminal element in a molding manner, and the embedded element is assembled in a mating socket, which will reduce the deformation of the terminal element during assembly. In particular, the correction device is arranged between the embedded element and the mating socket to adjust the embedded element so that the embedded terminal module and the printed circuit board are smoothly combined. In other words, the correction device is used to solve the problem of inability to assemble due to unevenness between the embedded terminal module and the printed circuit board. In other words, the correction device provides a coordinated correction.

An object of the present invention is to provide an embedded terminal module and a connector, and an assembling and correcting method thereof, wherein the embedded element will increase the structural strength of the terminal element.

In order to achieve at least one objective of the present invention described above, an embedded terminal module of the present invention, which can be adjusted and corrected on a printed circuit board, comprising:

an embedded terminal component;

a mating socket; and a correction device is located between the embedded terminal component and the mating socket to provide correction for the mating of the embedded terminal component and the printed circuit board.

In an embodiment of the present invention, wherein the correction device provides the embedded terminal component to adjust at least one direction of six axes of X, Y, Z, U, V, and W in the mating socket.

In an embodiment of the present invention, wherein the embedded terminal component comprises at least two terminal elements and at least two embedded elements, wherein each of the embedded elements is molded to cover each of the opposite terminal elements, and are assembled to the mating socket in mirror alignment, wherein the correction device comprises at least two correction units, and each of the correcting units is arranged between each of the embedded elements and the mating socket.

In an embodiment of the present invention, wherein the embedded terminal component comprises at least four terminal elements and at least four embedded elements, wherein each of the embedded elements is relatively molded to cover each of the terminal elements, and the four embedded elements are divided into two groups, which are assembled in the mating socket in a relatively mirror manner, wherein the correction device comprises at least four correction units, and each of the correcting units is arranged between each of the embedded elements and the mating socket.

In an embodiment of the present invention, wherein the mating socket comprises at least two embedded grooves, which respectively accommodate two of the embedded elements, wherein each of the correction units comprises a first correction portion, which is located between an upper surface of each of the embedded elements and each of the embedded grooves.

In an embodiment of the present invention, wherein the mating socket comprises at least four embedded grooves, which respectively accommodate four of the embedded elements, wherein each of the correction units comprises a first correction portion, which is located between an upper surface of each of the embedded elements and each of the embedded grooves.

In an embodiment of the present invention, wherein each of the correction units comprises a second correction portion, which is located between a side of each of the embedded elements and each of the embedded grooves.

In an embodiment of the present invention, wherein each of the terminal elements comprises a plurality of pin elements, wherein each of the embedded elements covers a plurality of the pin elements, so that the terminal element and the embedded element are integrated, wherein each of the pin elements comprises a pin body and a welded portion, wherein the welded portion is bent relative to the pin body, wherein the pin body has an embedded portion, an elastic portion and an extending portion, wherein the elastic portion is convexly bent between the embedded portion and the extending portion to ensure contact with an electronic component.

In order to achieve at least one objective of the present invention described above, the present invention also provides a connector, which is suitable for installing an electronic component, including:

the above-mentioned embedded terminal module;

a printed circuit board, wherein the embedded terminal module is disposed on the printed circuit board; and a locking module being arranged on the embedded terminal module, so that the electronic component fixable or unfixable arranged on the embedded terminal module.

In order to achieve at least one objective of the present invention described above, the present invention also provides a connector assembly and correction method, which includes the following steps:

(a) molding to form at least two embedded terminal elements, which are mirror-adjustably combined to a mating socket to form an embedded terminal module;

(b) setting the embedded terminal module on a printed circuit board;

(c) adjusting each of the embedded terminal elements through a correction device, so that the embedded terminal module is attached to the printed circuit board; and (d) movably installing a locking module at the embedded terminal module.

In an embodiment method of the present invention, wherein in step (c), the correction device comprises at least two correction units, wherein each of the embedded terminal elements is adjusted in at least any one of the six axes of X, Y, Z, U, V, and W through a first correction portion and a second correction portion of each of the correction units.

In an embodiment method of the present invention, wherein each of the first correction portions is located between an upper surface of an embedded element of each of the embedded terminal elements and each of the embedded grooves, wherein each of the second correction portion is located between a side of each of the embedded elements and each of the embedded grooves.

In an embodiment method of the present invention, wherein in step (d), the locking module forms an unlocked state and a locked state relative to the mating socket.

DETAILED DESCRIPTION OF THE PREFERRED EMBODIMENT

Figure 1:
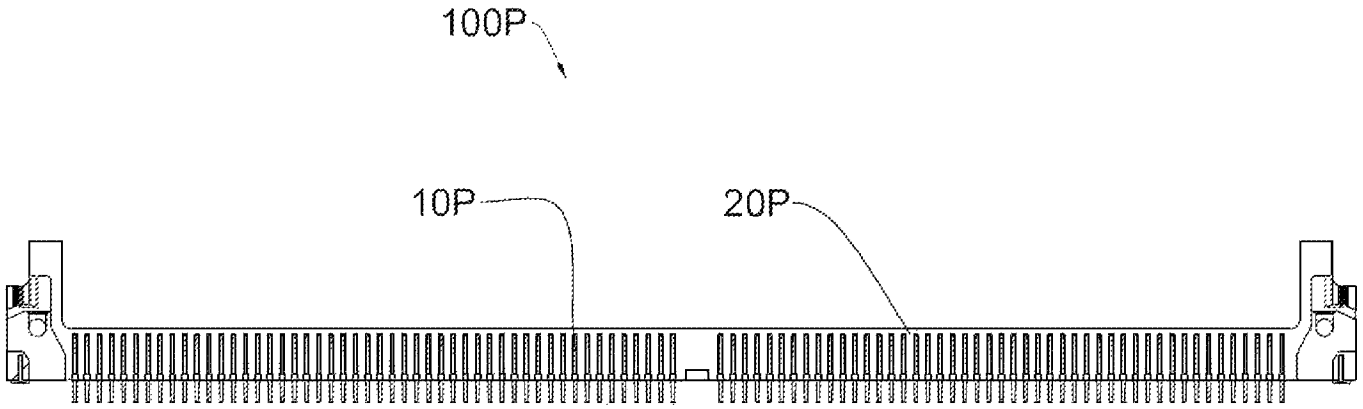
Fig. 1 PRIOR ART
FIG. 1 is a schematic diagram of a conventional connector.

In order to fully understand the purpose, features and effects of the present invention, the following specific embodiments and accompanying drawings are used to give a detailed description of the present invention. The description is as follows:

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Those skilled in the art should understand that, in the disclosure of the present invention, the indicating direction or positional relationship of the terms "longitudinal", "lateral", "upper", "lower", "front", "rear", "left", "right", "Vertical", "Horizontal", "Top", "Bottom", "Inner", "Outer", etc. are based on the direction or positional relationship shown in the drawings, which is only for the convenience of describing the present invention and simplifying the description, rather than indicating or implying that the device or element referred to must have a specific orientation or be constructed and operated in a specific orientation. Therefore, the above terms cannot be understood as a limitation of the present invention.

It is appreciated that the term "a" should be considered as "at least one" or "one or more", that is, in one embodiment, the number of an element may be one, while in other embodiments, the number of element can be multiple. The term "one" cannot be considered a restriction on quantity.

Figure 2:
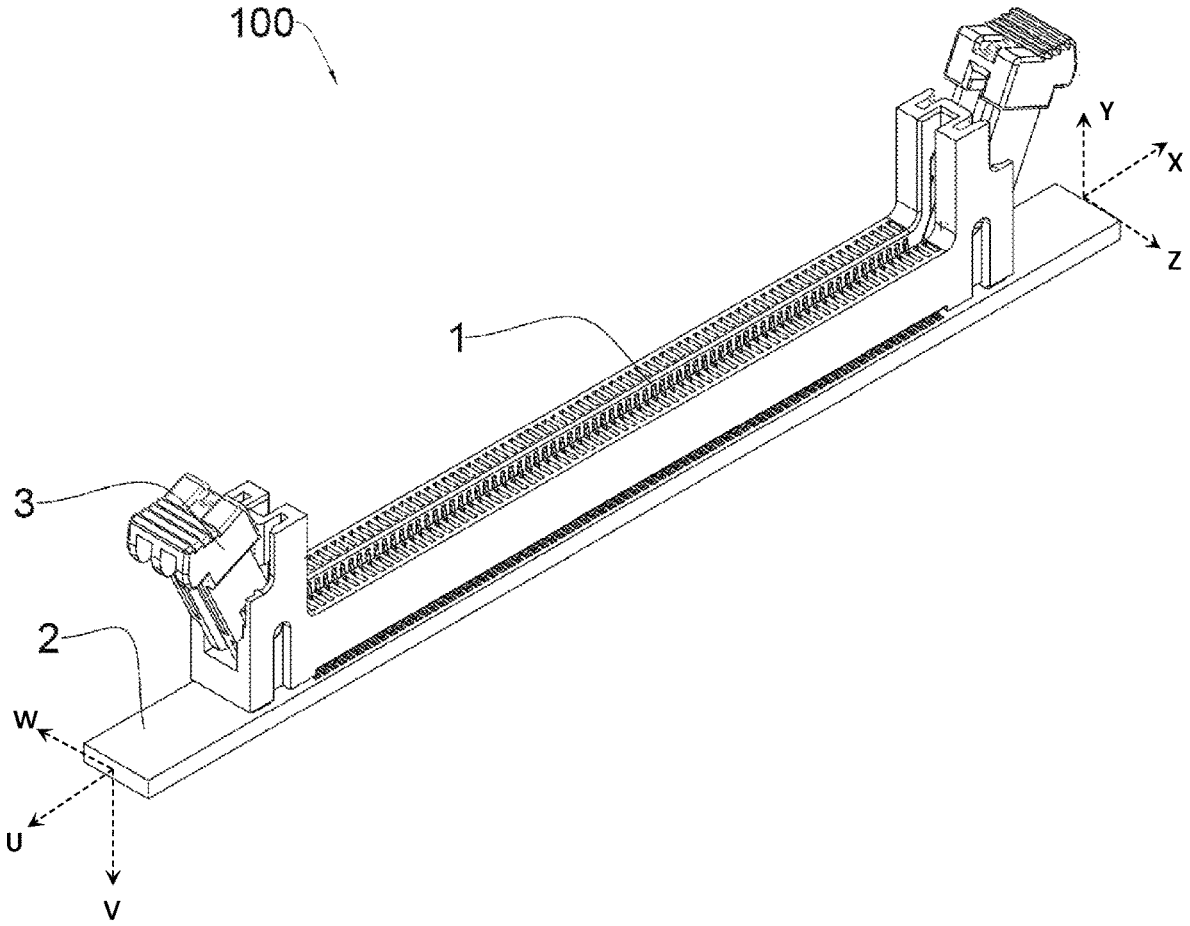
FIG. 2 is a perspective view of a connector according to a preferred embodiment of the present invention.
Figure 3A:
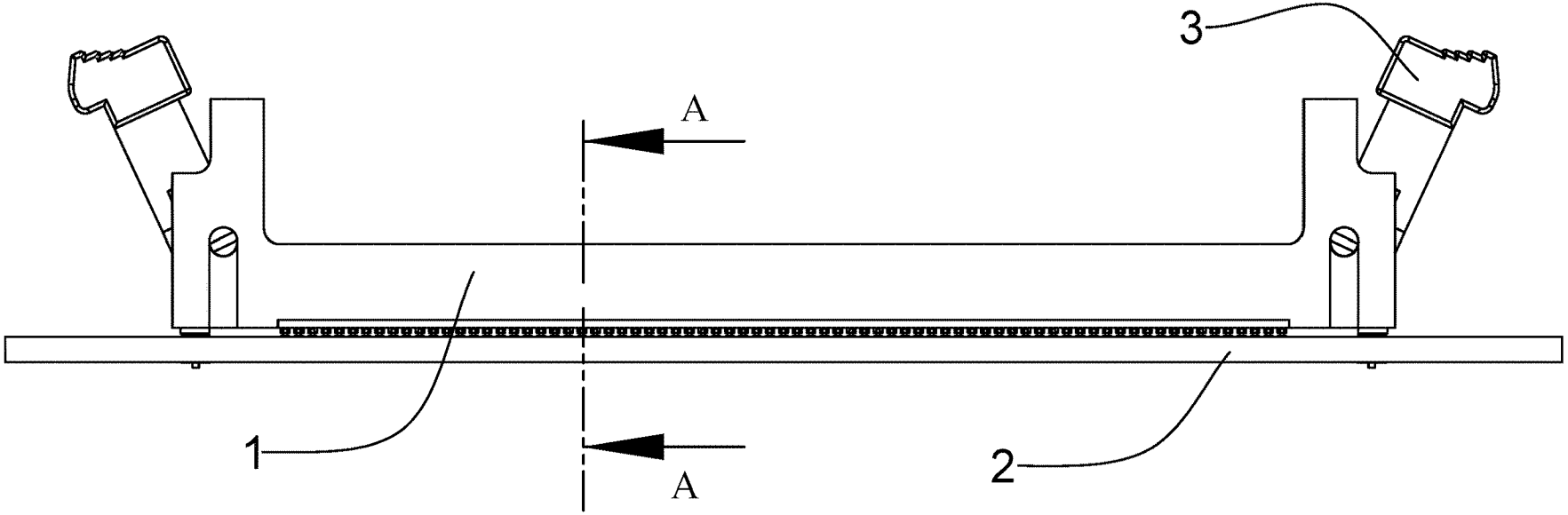
FIG. 3A is a schematic front view of a connector according to a preferred embodiment of the present invention.
Figure 3B:
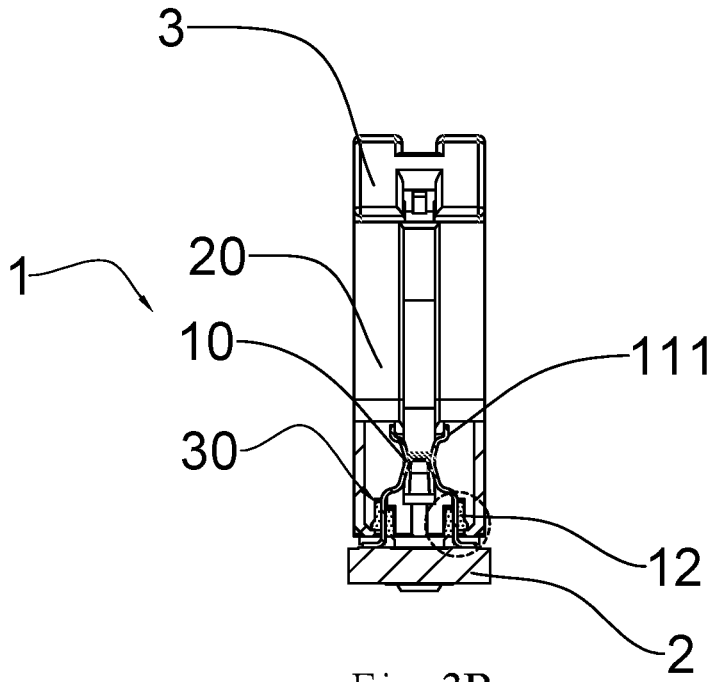
FIG. 3B is a schematic diagram according to the A-A section of FIG. 3A.
Figure 3C:
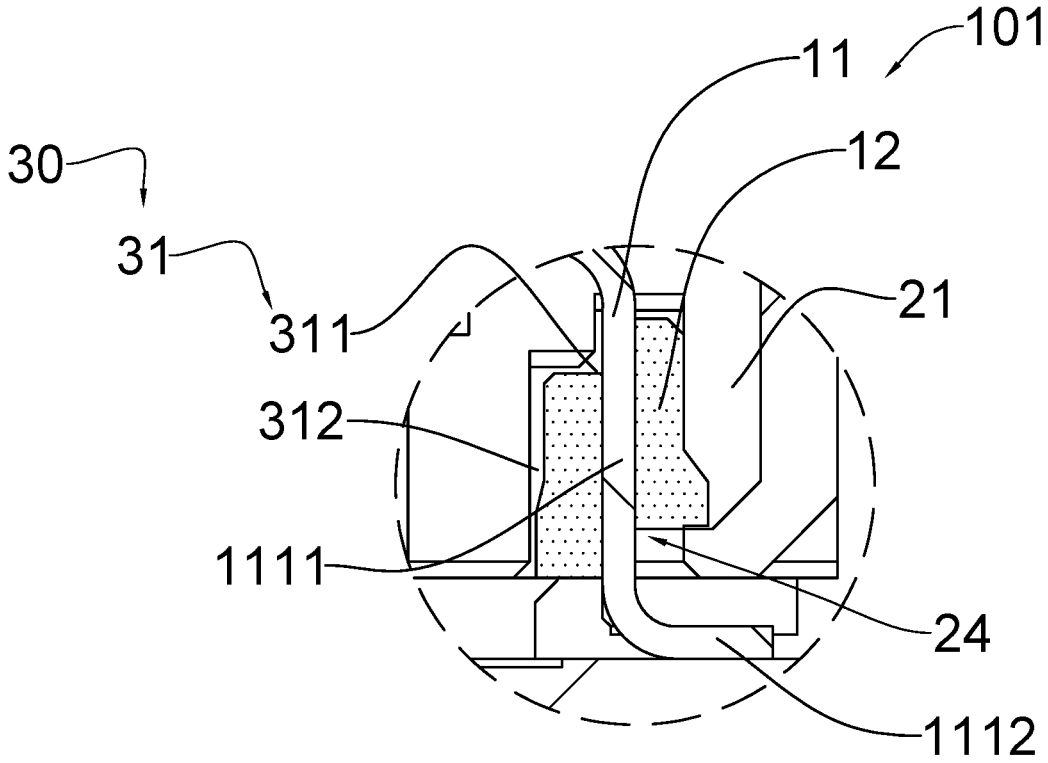
FIG. 3C is a partial enlarged schematic diagram according to FIG. 3B.
Figure 4A:
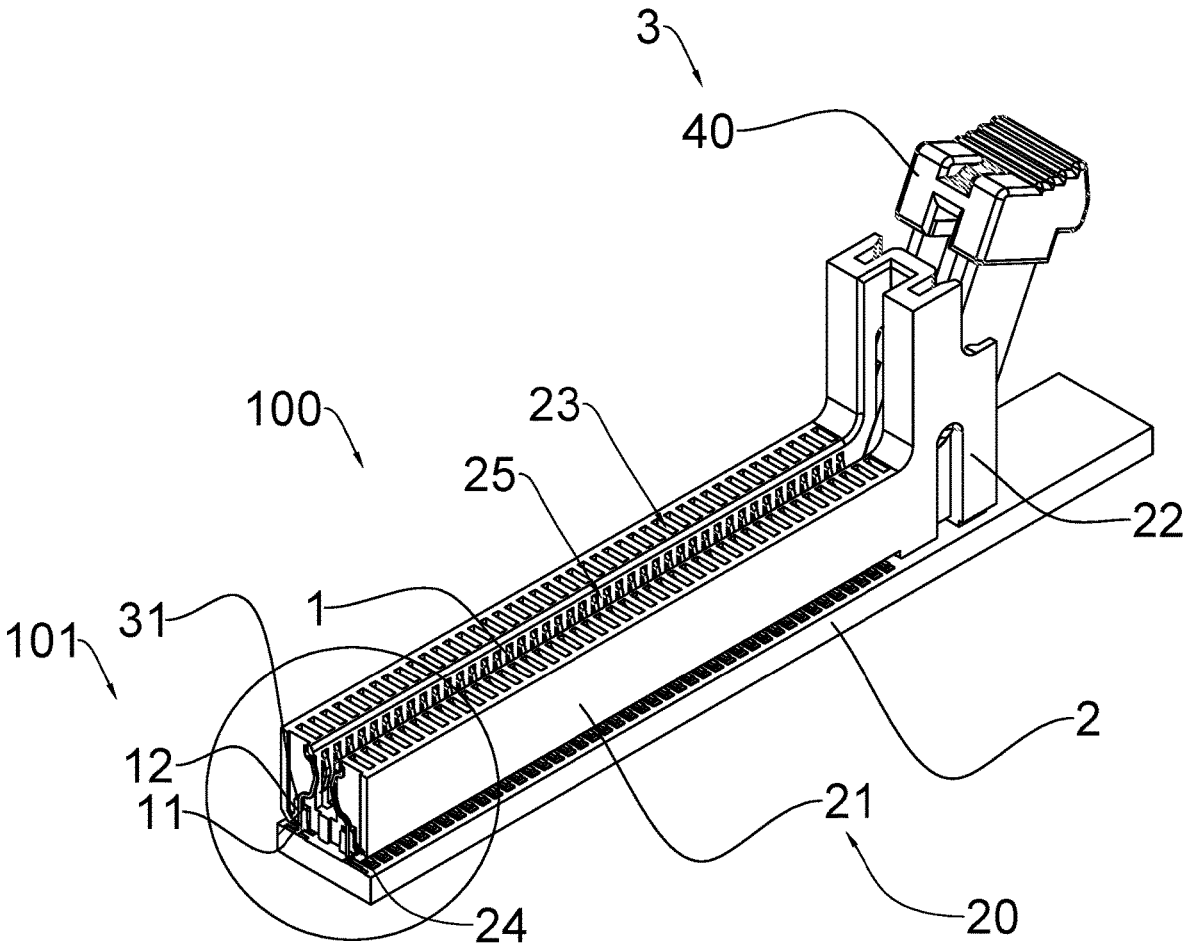
FIG. 4A is a sectional view of a connector according to a preferred embodiment of the present invention.
Figure 4B:
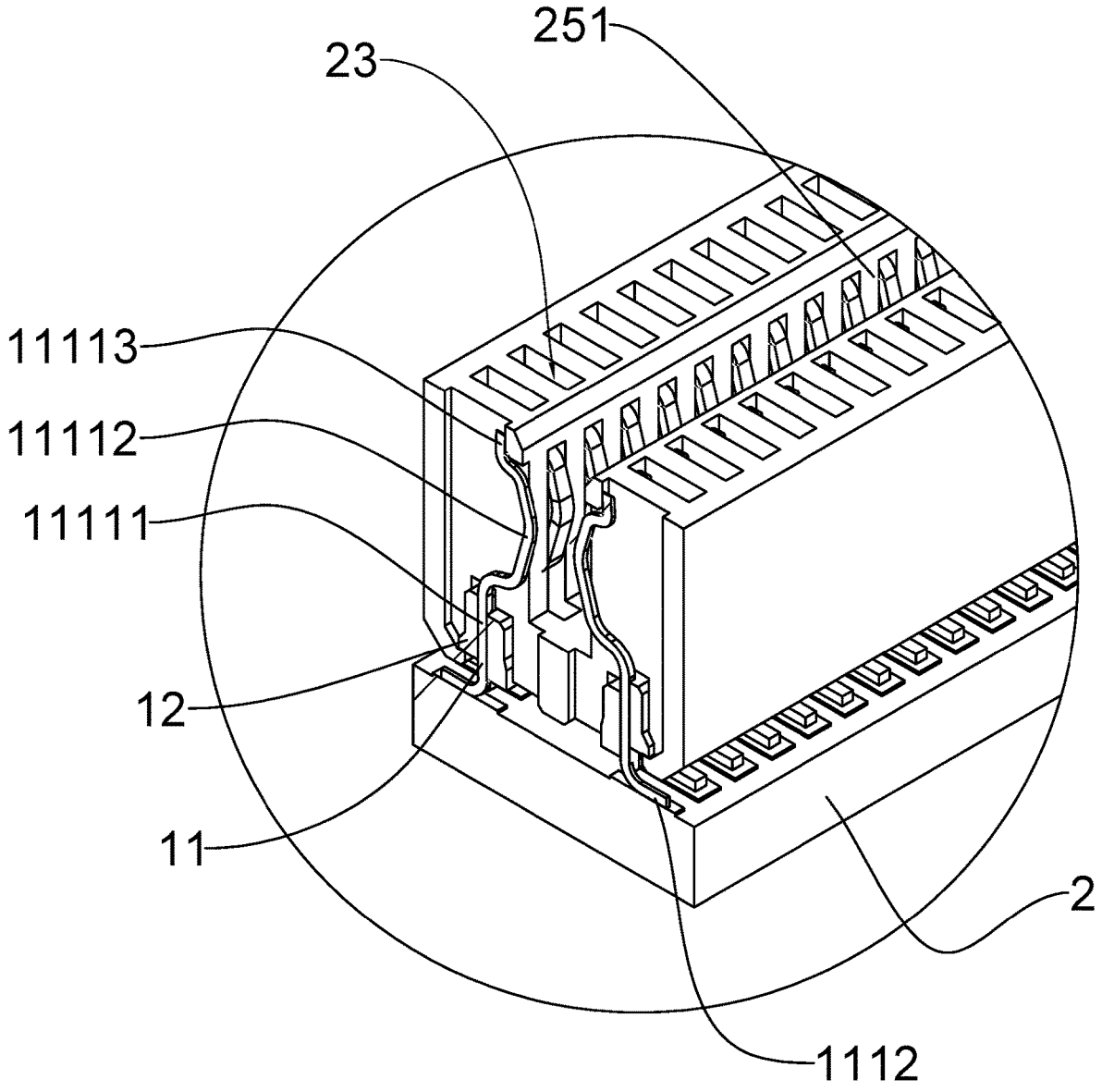
FIG. 4B is an enlarged schematic view of the cross-section according to FIG. 4A.
Figure 5:
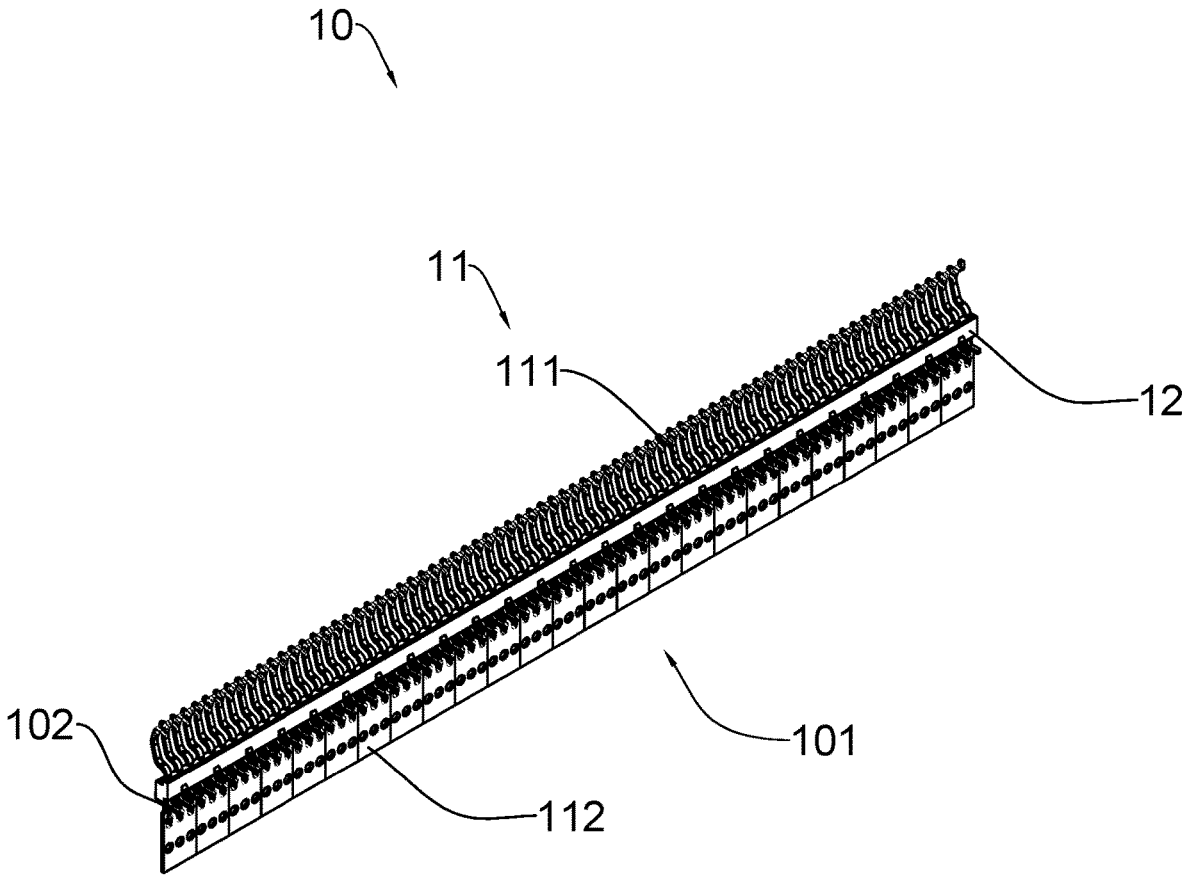
FIG. 5 is a perspective schematic view of the terminal element being molded by the embedded element according to the preferred embodiment of the present invention.
Figure 6:
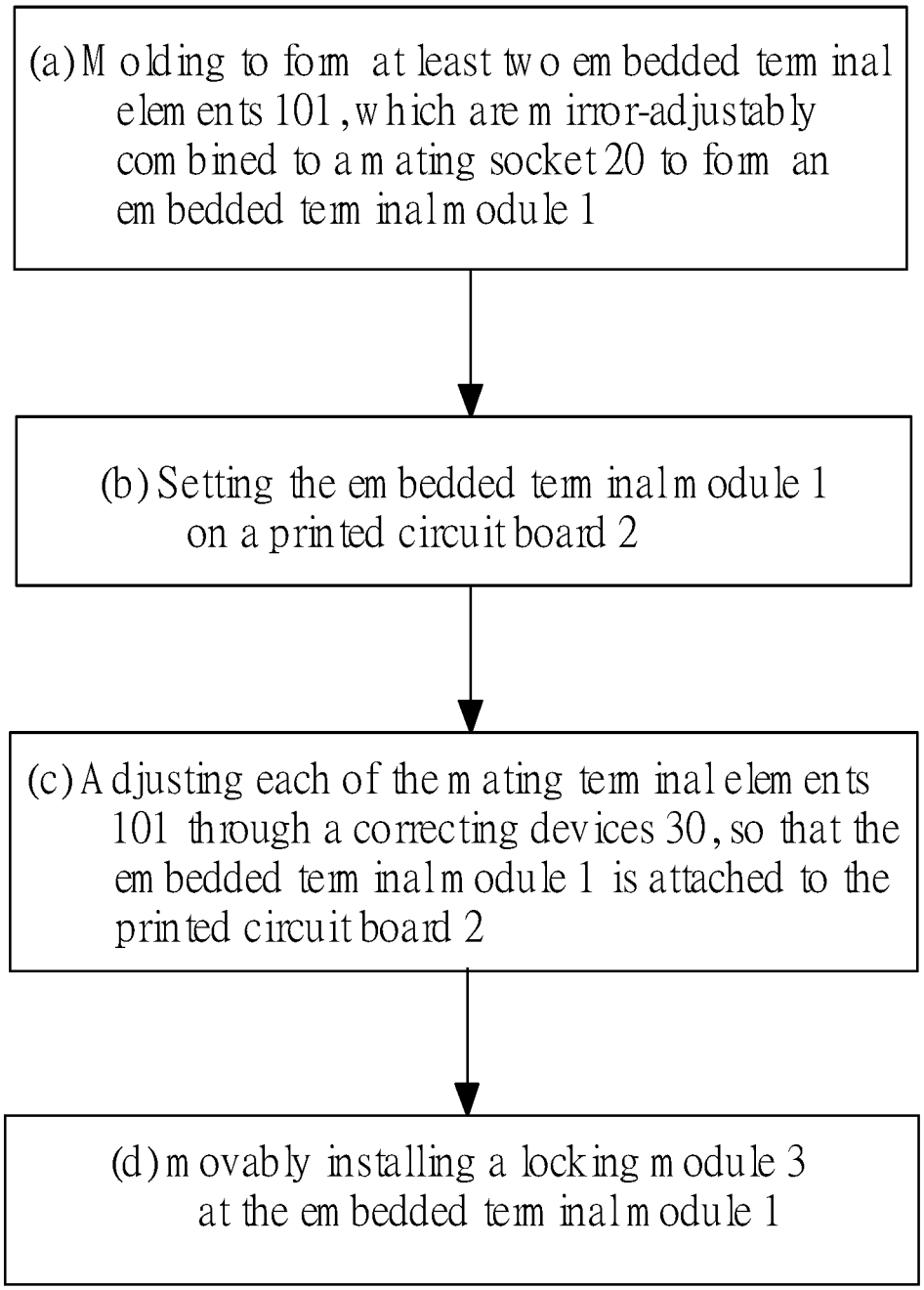
FIG. 6 is a logical schematic diagram of a connector assembly and correction method according to a preferred embodiment of the present invention.

Referring to FIGS. 2 and 5 an embedded terminal module with correction and a connector according to a preferred embodiment of the present invention. The connector 100 comprises an embedded terminal module 1, a printed circuit board 2, and a locking module 3. A correction device 30 of the embedded terminal module 1 enables the embedded terminal module 1 and the circuit board 2 to be smoothly combined. In other words, when unevenness occurs between the embedded terminal module 1 and the printed circuit board 2, the correcting device 30 is used to adjust the embedded terminal module 1 so that it is flat fit with the printed circuit board 2, in order to achieve the purpose of smoothly attaching the embedded terminal module 1 to the printed circuit board 2. The locking module 3 is arranged on the embedded terminal module 1 so as to be fixed by the locking module 3 when the electronic component is connected to the embedded terminal module 1. In particular, when the electronic component is to be detached or removed from the embedded terminal module 1, the locking module 3 is in an unlocked state, so that the electronic component can be easily separated from the embedded terminal module 1.

In the embodiment of the present invention, the embedded terminal module 1 comprises an embedded terminal component 10, a mating socket 20, and the correction device 30. The locking module 3 is disposed on the mating socket 20. The embedded terminal component 10 is mounted on the mating socket 20. The correction device 30 is located between the embedded terminal component 10 and the mating socket 20. When the embedded terminal module 1 and the printed circuit board 2 are combined, the correction device 30 is suitable for adjusting the position between the embedded terminal module 1 and the printed circuit board 2 to make the two smoothly combined. In other words, when unevenness occurs between the embedded terminal component 10 and the printed circuit board 2, the correction device 30 can adjust the embedded terminal component 10 relative to the printed circuit board 2 to overcome the unevenness. Thus, the embedded terminal component 10 is smoothly attached to the printed circuit board 2.

In the embodiment of the present invention, the embedded terminal component 10 comprises at least two terminal elements 11 and at least two embedded elements 12. Each of the embedded elements 12 is molded to cover each of the opposite terminal elements 11 to form an embedded terminal element 101. The two embedded terminal elements 101 are assembled to the mating socket 20 in a mirrored manner. The correction device 30 comprises at least two correction units 31, wherein each of the correction units 31 is disposed between each of the embedded elements 12 and the mating socket 20. Furthermore, each of the terminal elements 11 and each of the embedded elements 12 are integrated into one body through the process of embedding and injection, so that each of the terminal elements 11 will maintain the same height relative to the mating socket 20. At the same time, the correction unit 31 is used to adjust the relative position of the terminal elements 11 and the printed circuit board 2.

In the embodiment of the present invention, each of the terminal elements 11 comprises a plurality of pin elements 111, wherein the plurality of pin elements 111 are set in the mold, and the embedded element 12 is formed by injection to cover the plurality of pin elements 111, so that the terminal element 11 and the embedded element 12 are integrated. In particular, the embedded terminal component 10 comprises at least two of the terminal elements 11 and at least two of the embedded elements 12, wherein the two terminal elements 11 and the two embedded elements 12 are assembled in the mating socket 20 in a mirror-aligned manner. Furthermore, each of the terminal elements 11 is assembled on the mating socket 20 through each of the embedded elements 12. Because of the combination of the embedded elements 12 and the mating socket 20, compared with the traditional terminal assembly method, the terminal elements 11 will not be deformed, and each of the pin elements 111 maintains the same height relative to the mating socket 20. In addition, the number of the pin elements 111 is set in accordance with the connected electronic components, which is not a limitation of the present invention.

In the embodiment of the present invention, the mating socket 20 comprises a socket body 21, two locking portions 22, a plurality of terminal mating holes 23 and at least two embedded grooves 24. The two locking portions 22 are respectively located at two ends of the socket body 21 and extend upward to be used for installing the locking elements 40 respectively. The locking module 3 comprises two locking elements 40. Furthermore, the locking elements 40 are rotatably disposed on the locking portion 22. The plurality of terminal mating holes 23 and the two embedded grooves 24 are respectively located in the socket body 21 and communicate with each other. When the embedded terminal component 10 is installed in the mating socket 20, each of the embedded elements 12 is respectively disposed in each of the embedded grooves 24, and the plurality of pin elements 111 are disposed opposite to the plurality of terminal mating holes 23. In addition, the mating socket 20 further comprises at least one socket groove 25 which communicates with the plurality of terminal mating holes 23.

In the embodiment of the present invention, each of the correction units 31 comprises a first correction portion 311 and a second correction portion 312. Each of the first correction portions 311 is located between the upper portion of each of the embedded elements 12 and each of the embedded grooves 24. Each of the second correction portions 312 is located between the side of each of the embedded elements 12 and each of the embedded grooves 24. In other words, each of the first correction portions 311 is a first gap formed between the upper surface of each of the embedded elements 12 and each of the embedded grooves 24. Each of the second correction portions 312 is a second gap formed between the side surface of each of the embedded elements 12 and each of the embedded grooves 24. It is worth mentioning that each of the first correction portions 311 and each of the second correction portions 312 may communicate with each other to form a correction gap. In this way, through the correction gap, the embedded terminal element 101 can be adjusted in at least one direction of the six axes of X, Y, Z, U, V, and W.

In the embodiment of the present invention, each of the terminal elements 11 comprises a plurality of pin elements 111 and a positioning portion 112, wherein a plurality of the pin elements 111 are connected to the positioning portion 112, so that when each of the terminal elements 11 is set in the mold, a relative position of each of the terminal elements 11 in the mold is determined by the positioning portion 112. In addition, after each of the embedded elements 12 is molded to cover each of the terminal elements 11, the positioning portion 112 is separated and removed from the plurality of pin elements 111, so that each of the pin elements 111 is an independent element. Further to say, each of the terminal elements 11 is implemented as a metal plate, which has a plurality of the pin elements 111 and the positioning portion 112, when the positioning portion 112 is separated from the plurality of the pin elements 111, each of the pin elements 111 becomes an independent metal pin. Each of the terminal elements 11 has a series of separation lines 102 which are disposed between the pin elements 111 and the positioning portion 112 so that the positioning portion 112 is easily separated from the pin elements 111. In addition, each of the pin elements 111 comprises a pin body 1111 and a welded portion 1112, wherein the welded portion 1112 is bent relative to the pin body 1111. When the embedded terminal module 1 is installed on the printed circuit board 2, it is fixed by welding through the welded portion 1112. The pin body 1111 has an embedded portion 11111, an elastic portion 11112 and an extending portion 11113, wherein the elastic portion 11112 protrudes and bends between the embedded portion 11111 and the extending portion 11113. The embedded element 12 is formed in the embedded portion 11111. The elastic portion 11112 is used to ensure contact with the electronic components. The extending portion 11113 is used to guide the electronic component to contact the elastic portion 11112. When the plurality of pin elements 111 are relatively disposed in the plurality of terminal mating holes 23, the elastic portion 11112 of the pin body 1111 of each pin element 111 protrudes from a surface 251 of the socket groove 25 to conveniently contact with electronic components.

In addition, as shown in FIG. 5, the present invention provides a method for assembling and correcting a connector, wherein the connector is suitable for connecting an electronic component, and the method for assembling and correcting the connector comprises the following steps:

(a) molding to form at least two embedded terminal elements 101, which are mirror-adjustably combined to a mating socket 20 to form an embedded terminal module 1;

(b) setting the embedded terminal module 1 on a printed circuit board 2;

(c) adjusting each of the mating terminal elements 101 through a correcting devices 30, so that the embedded terminal module 1 is attached to the printed circuit board 2; and (d) movably installing a locking module 3 at the embedded terminal module 1.

In the step (a), making an embedded element 12 partially cover a terminal element 11 to form the embedded terminal element 101.

In the step (c), through a first correction portion 311 and a second correction portion 312 of the correction unit 31, the embedded terminal element 101 can be adjusted in at least one direction of the six axes of X, Y, Z, U, V, and W.

Each of the first correction portions 311 is located between the upper surface of the embedded element 12 of each of the embedded terminal elements 101 and an embedded groove 24. Each of the s second correction portions 312 is located between the side surface of the embedded element 12 of each of the embedded terminal elements 101 and the embedded groove 24.

In the step (d), the two locking elements 40 of the locking module 3 are respectively disposed on the two locking portions 22 of the mating socket 20, wherein the two locking portions 22 are respectively located at two ends of the socket body 21 of the mating socket 20 and extend upward.

In the step (d), the locking module 3 has an unlocked state and a locked state relative to the mating socket 20. In other words, when the electronic component is to be detached or removed from the embedded terminal module 1, the locking module 3 is in an unlocked state, so that the electronic component can be easily separated from the embedded terminal module 1. When the electronic component is installed in the embedded terminal module 1, the locking module 3 is in a locked state to fix the electronic component.

Figure 7:
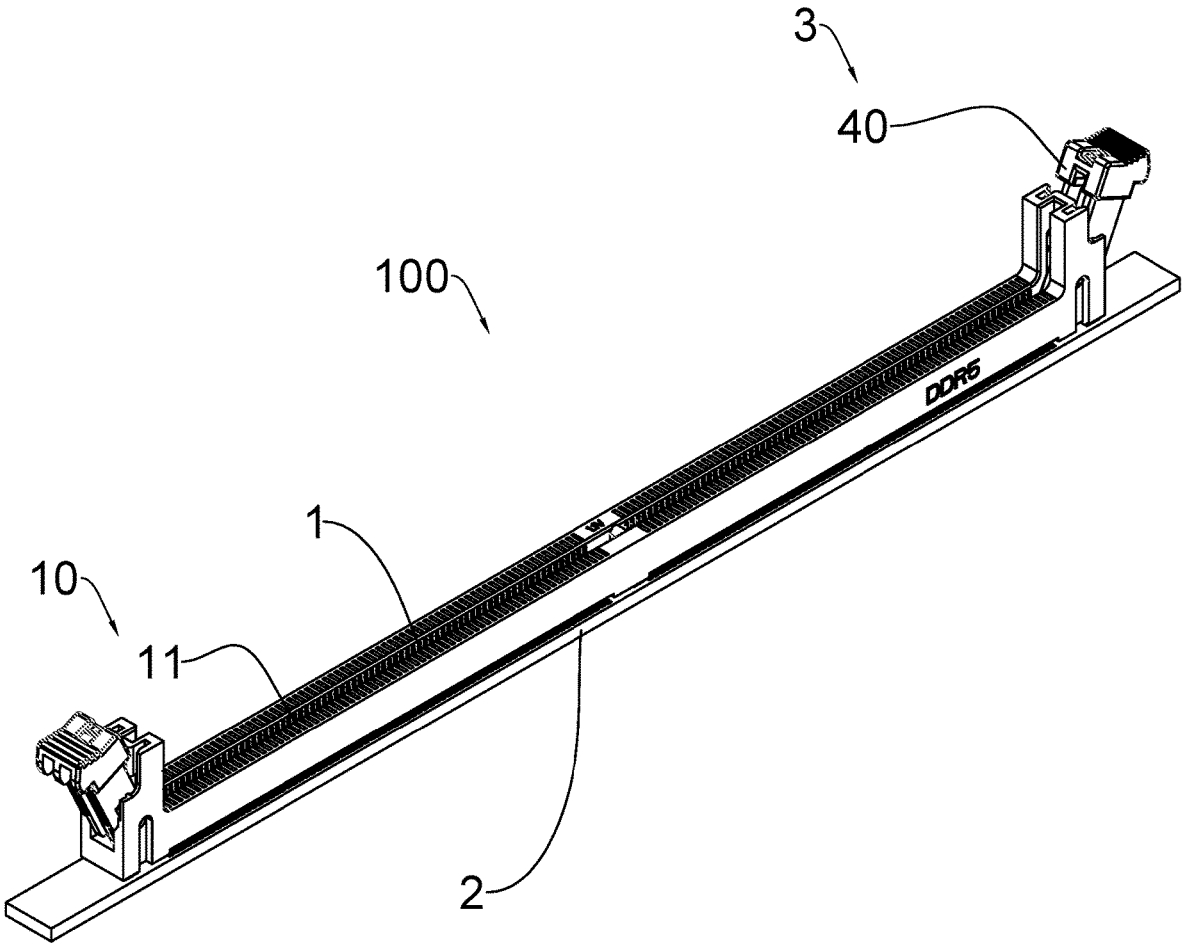
FIG. 7 is a perspective view of a modified embodiment of the connector according to the preferred embodiment of the present invention.

As shown in FIG. 7, it is an embedded terminal module and its connector according to a modified embodiment of the preferred embodiment of the present invention. The embedded terminal component 10 includes at least four sets of terminal elements 11 and at least four sets of embedded elements 12. Each set of the embedded elements 12 is relatively molded to cover each set of the terminal elements 11, and the four sets of the embedded elements 12 are divided into two groups, which are assembled in the mating socket 20 in a relatively mirror manner. It is worth mentioning that the correction device 30 comprises at least four correction units 31, wherein each of the correction units 31 is disposed between each of the embedded elements 12 and the mating socket 20.

In addition, the electronic components applicable to the connector 100 of this modified embodiment can be implemented as DDR5, but this is not a limitation of the present invention.

One skilled in the art will understand that the embodiment of the present invention as shown in the drawings and described above is exemplary only and not intended to be limiting. The purpose of the present invention has been completely and effectively achieved. The functions and structural principles of the present invention have been shown and explained in the embodiments. Without departing from the principles, the implementation of the present invention may have any deformation or modification.

What is claimed is:

1. A method for assembling and correcting a connector which is used to connect an electronic component, comprising steps of:

(a) molding to form at least two embedded terminal elements, which are mirror-adjustably combined to a mating socket to form an embedded terminal module;

(b) setting said embedded terminal module on a printed circuit board;

(c) adjusting a position between said embedded terminal elements and said printed circuit board through a correction device so as to enable said embedded terminal elements and said printed circuit board being combined, so that said embedded terminal module is attached to said printed circuit board; and (d) movably installing a locking module at said embedded terminal module.

2. The method for assembling and correcting a connector, as recited in claim 1, wherein in step (c), said correction device comprises at least two correction units, wherein each of the embedded terminal elements is adjusted in at least any one of the six axes through a first correction portion and a second correction portion of each of said correction units.

3. The method for assembling and correcting a connector, as recited in claim 2, wherein each of said first correction portions is located between an upper surface of an embedded element of each of said embedded terminal elements and each of said embedded grooves, wherein each of said second correction portion is located between a side of each of said embedded elements and each of said embedded grooves.

4. The method for assembling and correcting a connector, as recited in claim 1, wherein in step (d), said locking module forms an unlocked state and a locked state relative to said mating socket.

5. An embedded terminal module for adjustable correction and setting on a printed circuit board, comprising:

an embedded terminal component;

a mating socket; and a correction device being arranged between said embedded terminal component and said mating socket for adjusting a position between said embedded terminal component and said printed circuit board enabling said embedded terminal component and said printed circuit board being combined, wherein said correction device provides said embedded terminal component to adjust at least one direction of six axes in said mating socket.

6. An embedded terminal module for adjustable correction and setting on a printed circuit board, comprising:

an embedded terminal component comprising at least four terminal elements and at least four embedded elements, wherein said embedded elements are relatively molded to cover said terminal elements respectively, and said four embedded elements are divided into two groups;

a mating socket, wherein said two groups of said four embedded elements are assembled in said mating socket in a relatively mirror manner; and a correction device being arranged between said embedded terminal component and said mating socket for adjusting a position between said embedded terminal component and said printed circuit board enabling said embedded terminal component and said printed circuit board being combined, wherein said correction device comprises at least four correction units, wherein each of said correcting units is arranged between each of said embedded elements and said mating socket.

7. The embedded terminal module, as recited in claim 6, wherein said mating socket comprises at least four embedded grooves, which respectively accommodate four of said embedded elements, wherein each of said correction units comprises a first correction portion, which is located between an upper surface of each of said embedded elements and each of said embedded grooves.

8. The embedded terminal module, as recited in claim 7, wherein each of said correction units comprises a second correction portion, which is located between a side of each of said embedded elements and each of said embedded grooves.

9. The embedded terminal module, as recited in claim 8, wherein each of said terminal elements comprises a plurality of pin elements, wherein each of said embedded elements covers a plurality of said pin elements, so that said terminal element and said embedded element are integrated, wherein each of said pin elements comprises a pin body and a welded portion, wherein said welded portion is bent relative to said pin body, wherein said pin body has an embedded portion, an elastic portion and an extending portion, wherein said elastic portion is convexly bent between said embedded portion and said extending portion to ensure contact with an electronic component.

10. An embedded terminal module for adjustable correction and setting on a printed circuit board, comprising:

a mating socket having two embedded grooves;

an embedded terminal component comprising at least two terminal elements and at least two embedded elements, wherein said embedded elements are molded to cover said opposite terminal elements respectively, and are assembled to said mating socket in mirror alignment, wherein said at least two embedded grooves of said mating socket respectively accommodate said at least two embedded elements; and a correction device being arranged between said embedded terminal component and said mating socket for adjusting a position between said embedded terminal component and said printed circuit board enabling said embedded terminal component and said printed circuit board being combined, wherein said correction device comprises at least two correction units, and each of said correcting units is arranged between each of said embedded elements and said mating socket, wherein each of said correction units comprises a first correction portion which is located between an upper surface of each of said embedded elements and each of said embedded grooves.

11. The embedded terminal module, as recited in claim 10, wherein each of said correction units comprises a second correction portion, which is located between a side of each of said embedded elements and each of said embedded grooves.

12. The embedded terminal module, as recited in claim 11, wherein each of said terminal elements comprises a plurality of pin elements, wherein each of said embedded elements covers a plurality of said pin elements, so that said terminal element and said embedded element are integrated, wherein each of said pin elements comprises a pin body and a welded portion, wherein said welded portion is bent relative to said pin body, wherein said pin body has an embedded portion, an elastic portion and an extending portion, wherein said elastic portion is convexly bent between said embedded portion and said extending portion to ensure contact with an electronic component.

13. A connector for an electronic component, comprising:

an embedded terminal module comprising an embedded terminal component, a mating socket and a correction device, wherein said correction device is located between said embedded terminal component and said mating socket;

a printed circuit board, wherein said embedded terminal module is adjustably disposed on said printed circuit board, and said correction device is arranged for adjusting a position between said embedded terminal component and said printed circuit board enabling said embedded terminal component and said printed circuit board being combined, wherein said correction device provides said embedded terminal component to adjust at least one direction of six axes in said mating socket; and a locking module being arranged on said embedded terminal module, so that said electronic component fixable or unfixable arranged on said embedded terminal module.

14. A connector for an electronic component, comprising:

an embedded terminal module comprising an embedded terminal component, a mating socket and a correction device, wherein said correction device is located between said embedded terminal component and said mating socket, wherein said embedded terminal component comprises at least two terminal elements and at least two embedded elements, wherein each of said embedded elements is molded to cover each of said opposite terminal elements and are to said mating socket in mirror alignment, wherein said correction device comprises at least two correction units each of is arranged between each of said embedded elements and said mating socket, wherein each of said correction units comprises a first correction portion and a second correction portion, wherein each of the first correction portions is located between an upper portion of each of said embedded elements and each of said embedded grooves, wherein each of said second correction portions is located between a side of each of said embedded elements and each of said embedded grooves, wherein said first correction portion and said second correction portion communicate with each other;

a printed circuit board, wherein said embedded terminal module is adjustably disposed on said printed circuit board, and said correction device is arranged for adjusting a position between said embedded terminal component and said printed circuit board enabling said embedded terminal component and said printed circuit board being combined; and a locking module being arranged on said embedded terminal module, so that said electronic component fixable or unfixable arranged on said embedded terminal module.

* * * * *